US011622187B2

(12) United States Patent
Thielen

(10) Patent No.: US 11,622,187 B2
(45) **Date of Patent: *Apr. 4, 2023**

(54) TAP DETECTION

(71) Applicant: Sonova AG

(72) Inventor: Anne Thielen, Stäfa (CH)

(73) Assignee: Sonova AG, Staefa (CH)

( * ) Notice: Subject to any disclaimer, the term of this patent is extended or adjusted under 35 U.S.C. 154(b) by 113 days.

This patent is subject to a terminal disclaimer.

(21) Appl. No.: 16/832,002

(22) Filed: Mar. 27, 2020

(65) Prior Publication Data

US 2020/0314525 A1 Oct. 1, 2020

Related U.S. Application Data

(63) Continuation of application No. 16/368,880, filed on Mar. 29, 2019, now Pat. No. 10,959,008.

(51) Int. Cl.
*H04R 1/10* (2006.01)

(52) U.S. Cl.
CPC ..... *H04R 1/1041* (2013.01); *H04R 2420/07* (2013.01)

(58) Field of Classification Search
CPC ..... H04N 5/232; H04N 5/28; H04N 5/76; H04N 5/77; H04N 5/772; H04N 9/802; H04N 9/8205; H04N 9/8211; H04R 1/1041; H04R 1/1016; H04R 1/1091; H04R 2225/61; H04R 2420/07; H04R 25/30; H04R 25/55; H04R 1/1083; H04R 1/222; H04R 2225/31; H04R 2225/41; H04R 2410/07; H04R 2460/09; H04R 2499/11; H04R 25/305; H04R 25/405; H04R 25/505; H04R 25/65; H04R 3/002; H04R 3/005;

(Continued)

(56) References Cited

U.S. PATENT DOCUMENTS 5,636,285 A 6/1997 Sauer
5,835,611 A * 11/1998 Kaiser ..... H04R 25/70 381/314

(Continued)

FOREIGN PATENT DOCUMENTS

WO 2014049148 A1 4/2014
WO 2016174659 A1 6/2016

(Continued)

*Primary Examiner* — Lun-See Lao

(74) *Attorney, Agent, or Firm* — ALG Intellectual Property, LLC

(57) ABSTRACT

The disclosed technology generally relates to a hearing device configured to detect tapping based on input from at least two sensors of the hearing device. The tapping can relate to a tapping gesture that includes a single tap or double tapping. In response to the single or double tap, the hearing device can perform an operation to modify the device (e.g., change the mode, change, or modify a setting, provide a sound, or perform a task). The first sensor can be an accelerometer configured to detect a change in acceleration of the hearing device and the second sensor can include a photodiode to detect a change in distance between the hearing device and the ear with the hearing device. The disclosed technology can be implemented in a method and comprises a computer-readable medium storing instructions to perform the method.

19 Claims, 4 Drawing Sheets

(58) Field of Classification Search

CPC .... H04R 5/0335; H04R 25/43; H04R 25/554; H04R 25/558; H04Q 2209/823; H04Q 9/04; H04Q 9/00; H04W 4/02; H04W 64/006; H04W 84/18; H04W 12/068; H04W 12/069; H04W 4/027; H04W 4/12; H04W 4/16; H04W 4/185; H04W 52/0251; G10L 25/18; G10L 25/48; G10L 19/008; G10L 21/0208; G10L 21/0232; G10L 25/03; G10L 25/51; G10L 25/87; H04M 1/6008; H04M 1/72412; H04M 1/72448; H04M 1/72454; H04M 19/04; H04M 19/047; H04M 1/72403; H04M 1/72406; H04M 1/72421; H04M 1/72427; H04M 1/7243; H04M 1/72433; H04M 1/72436; H04M 1/72442; H04M 1/72457; H04M 1/72463; H04M 1/72484; H04M 2250/52; H04M 2250/60; H04B 11/00; H04B 1/48; H04L 51/066; H04L 51/38; H04L 67/2809; H04L 67/34; H04L 67/36; H04L 67/38; H04S 7/301; H04S 7/302; H04S 7/305

USPC ..... 381/74, 312, 314, 321, 322; 700/94

See application file for complete search history.

(56) References Cited

U.S. PATENT DOCUMENTS

| | | | |
|---|---|---|---|
| 7,483,832 | B2 | 1/2009 | Tischer |
| 8,824,712 | B2 | 9/2014 | Starkey |
| 9,219,965 | B2 | 12/2015 | Oticon |
| 9,420,386 | B2 | 8/2016 | Rass |
| 9,635,477 | B2 | 4/2017 | Lowmiller et al. |
| 9,712,932 | B2 | 7/2017 | Starkey |
| 9,940,928 | B2 | 4/2018 | Starkey |
| 10,284,939 | B2 | 5/2019 | Radin et al. |
| 10,291,975 | B2 * | 5/2019 | Howell ..... H04R 1/1041 |
| 10,341,784 | B2 | 7/2019 | Starkey |
| 10,631,113 | B2 * | 4/2020 | Mishra ..... A61B 5/6803 |
| 10,638,214 | B1 * | 4/2020 | Delhoume ..... G06F 3/03547 |
| 10,959,008 | B2 * | 3/2021 | El Guindi ..... H04R 25/30 |
| 2008/0240458 | A1 * | 10/2008 | Goldstein ..... H04R 1/1083 381/72 |
| 2008/0292126 | A1 | 11/2008 | Starkey |
| 2009/0257608 | A1 * | 10/2009 | Chew ..... H04R 25/305 381/60 |
| 2011/0091058 | A1 | 4/2011 | Starkey |
| 2011/0238419 | A1 | 9/2011 | Barbel |
| 2011/0249841 | A1 | 10/2011 | Starkey |
| 2012/0135687 | A1 | 5/2012 | Thorn et al. |
| 2012/0178063 | A1 | 7/2012 | Bristow et al. |
| 2012/0299950 | A1 | 11/2012 | Ali et al. |
| 2014/0111415 | A1 * | 4/2014 | Gargi ..... G06F 16/9537 345/156 |
| 2015/0187206 | A1 * | 7/2015 | Saurin ..... G08C 17/02 340/5.61 |
| 2016/0143582 | A1 | 5/2016 | Connor |
| 2016/0192073 | A1 * | 6/2016 | Poornachandran .. H04R 1/1041 381/26 |
| 2017/0055511 | A1 * | 3/2017 | Mafra-Neto ..... A01M 1/20 |
| 2017/0359661 | A1 * | 12/2017 | Goorevich ..... H04R 25/606 |
| 2018/0020328 | A1 * | 1/2018 | Monnin ..... H04M 1/72403 |
| 2018/0275956 | A1 | 9/2018 | Reed et al. |
| 2019/0108330 | A1 * | 4/2019 | Sikder ..... G06F 21/44 |
| 2019/0171249 | A1 | 6/2019 | Ontario |
| 2021/0076212 | A1 * | 3/2021 | Manikantan Shila ..... H04L 63/0861 |
| 2021/0127215 | A1 * | 4/2021 | Goorevich ..... H04R 25/75 |

FOREIGN PATENT DOCUMENTS

| | | | |
|---|---|---|---|
| WO | 2016167877 | A1 | 10/2016 |
| WO | 2017149526 | A1 | 5/2017 |
| WO | 2019043687 | A2 | 3/2019 |
| WO | 2019195288 | A1 | 10/2019 |

* cited by examiner

TAP DETECTION

CROSS-REFERENCED APPLICATION

This application claims priority to U.S. patent application Ser. No. 16/368,880 filed on Mar. 29, 2019, titled "Adaptive Tapping for Hearing Devices," the disclosure of which is incorporated by reference for its entirety.

TECHNICAL FIELD

The disclosed technology generally relates to a hearing device configured to a tapping gesture (e.g., a single or double tap) based on input from at least two sensors of the hearing device.

BACKGROUND

To improve everyday user satisfaction with hearing devices, a hearing device user desires a simple means to adjust hearing device parameters or control their hearing device. Currently, users can toggle buttons or turn dials on the hearing device to adjust parameters. For example, a user can toggle or press a button to increase the volume of a hearing device.

Also, hearing device users can use remote controls or control signals from an external wireless device to adjust parameters of hearing devices. For example, a user can have a remote control that has a "+" button for increasing the volume of a hearing device and "−" for decreasing the volume of a hearing device. If the user pushes either button, the remote control transmits a signal to the hearing device and the hearing device is adjusted in accordance with a control signal. Like a remote control, a user can use a mobile device to adjust the hearing device parameters. For example, a user can use a mobile application and its graphical user interface to adjust the settings of a hearing device via wireless communication. The mobile device can transmit wireless control signals to the hearing device accordingly.

However, the current technology for adjusting a hearing device has a few drawbacks. To push a button or turn a dial, a user generally needs good dexterity to find and engage the button or dial appropriately. This can be difficult for users with limited dexterity or it can be cumbersome to perform because a user may have difficulty seeing the location of these buttons (especially for elderly individuals).

Accordingly, there exists a need to provide technology that allows a user to easily adjust and/or control hearing device parameters, provide input into the hearing device, and/or provide additional benefits.

SUMMARY

This summary is provided to introduce a selection of concepts in a simplified form that are further described below in the Detailed Description. This summary is not intended to identify key features of the claimed subject matter.

The disclosed technology relates to a hearing device. The hearing device can comprise: a processor configured to control operation of the hearing device and a memory storing instructions that when executed by the processor cause the hearing device to perform operations. The operations can comprise: receiving a tapping signal from a first sensor configured to detect a change in acceleration of the hearing device; receiving a verification signal from a second sensor; and based on the received tapping signal and the received verification signal, determining that the tapping signal relates to a tap gesture associated with the hearing device. A tap gesture is generally a movement or detection of a movement that is used to express an intent or trigger an operation to be performed. The tapping gesture can be a single tap or double tap of an ear or hearing device in contact with the ear. For example, a tap gesture can be a double tap of an ear to answer a phone call.

In response to the received tap gesture, the hearing device can execute an operation to modify the hearing device (e.g., answer a phone call, decline a phone call, change a beamformer setting, or modify the sound output of the hearing device). A user can also use tap gestures to control the hearing device (e.g., change a mode of operation, turn a feature on or off).

In some implementations, the first sensor is an accelerometer and the second sensor comprises a photodiode. The second sensor can be configured to measure a change in distance between an ear in physical contact with the hearing device and the second sensor, wherein the distance is associated with the movement an ear in response to a tap of the ear. For example, as shown in FIG. 2A, the change in distance can be associated with a user tapping the ear in contact the hearing device to trigger a tapping gesture.

The first and second sensor can produce signals that the processor can be use to determine that a tap gesture was received. For example, the tapping signal and the verification signal can function as an "and" gate where both signals are required for the gate to be true (e.g., detect a tap gesture). The tapping signal and the verification signal can a correlation (e.g., magnitude, timing, order of being received, individual values) between the signals can also be used to determine whether a tapping gesture was robustly received. For example, if the timing of the two signals is far part (e.g., more than 5 seconds), it can be determine that a tap gesture was not received because the probability that the tap gesture occurred is too low for this timing. Alternatively, a processor can use compared expected magnitudes or timing of the signals to actual magnitudes or timing of the signals to determine that a tapping gestures was received.

The second sensor can also be a temperature sensor, a capacitive sensor, a mechanical sensor configured to detect touch, an antenna (e.g., with a transceiver to measure impedance), a microphone configured to generate a tapping signal when tapped, a magnetic sensor configured to detect proximity of an ear to the sensor, pressure sensor, an optical sensor, or a medical sensor. Also, in some implementations, an antenna and its transceiver can be used to measure a change in impedance, and this change in impedance can be considered a verification signal. In such implementations, the antenna and/or its transceiver can be considered a second sensor.

Optionally, the hearing device can determine when it is expecting to receive a tap gesture based on context of the hearing device. Determining the context for the hearing device can be based on sound received at the hearing device. For example, the hearing device can use its classifier to classify the type of sound received at the hearing device and based on this classification, it can determine that a particular tap gesture is expected (e.g., if the received sound is too loud, it can expect to receive a tap gesture to change the volume; if a beamforming operation is recommended by the classifier but not comfortable for the user, the hearing device can expect a tap gesture to change the beam forming settings).

Alternatively or additionally, determining the context for the hearing device can be based on a wireless communication signal from an external device received at the hearing device, and wherein the wireless communication signal is from a mobile device and the wireless communication signal is related to answering or rejecting a phone call. Determining the context of for an expected tap can reduce battery power demand on the hearing device because the tap gesture feature can be activated only when a tap is expected (e.g., a few minutes or seconds before a tap is expected) and deactivated when a tap gesture is not expected.

The disclosed technology includes a method for detecting a tapping gesture. The method can also be stored on a computer-readable medium as operations, wherein a processor can carry out the operations and cause the hearing device to perform the operations.

Figure 1:
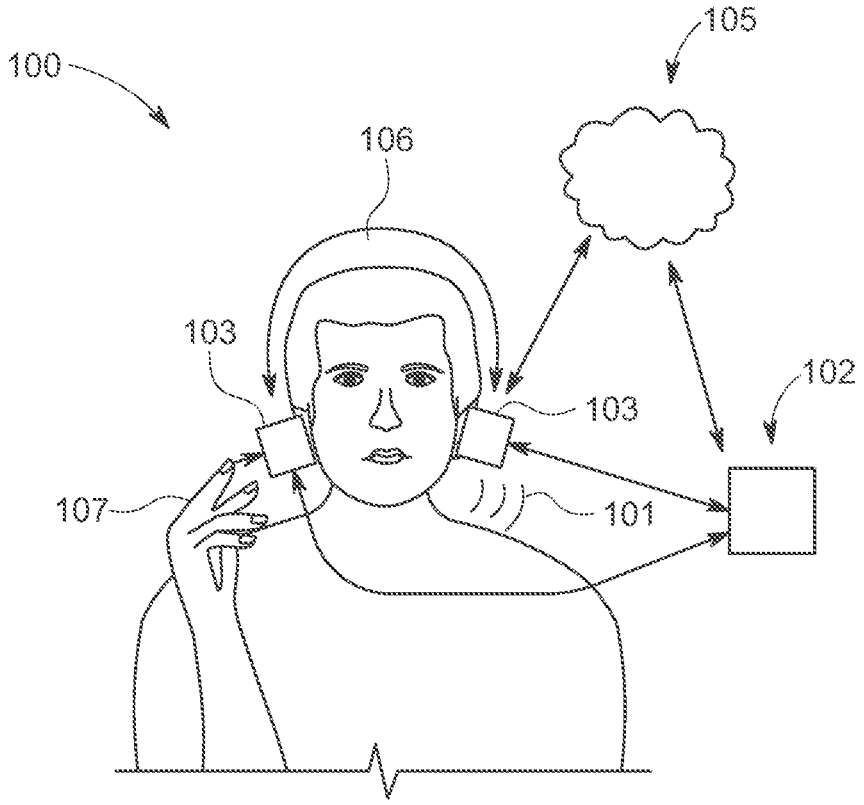
FIG. 1 illustrates a communication environment where a hearing device user can tap a hearing device or ear with a hearing device in accordance with some implementations of the disclosed technology.

The drawings are not to scale. Some components or operations may be separated into different blocks or combined into a single block for the purposes of discussion of some of the disclosed technology. Moreover, while the technology is amenable to various modifications and alternative forms, specific implementations have been shown by way of example in the drawings and are described in detail below. The intention, however, is not to limit the technology to the selected implementations described. On the contrary, the technology is intended to cover all modifications, equivalents, and alternatives falling within the scope of the technology as defined by the appended claims.

DETAILED DESCRIPTION

To enable users to adjust hearing device parameters, hearing devices can have an accelerometer and use it to implement tap control. Tap control generally refers to a hearing device user tapping on the hearing device, tapping on the ear with the hearing device, or tapping on their head a single or multiple times to control the hearing device. Tapping includes touching a hearing device a single or multiple times with a body part or object (e.g., pen)—generically referred to as tap gestures.

The accelerometer can sense the tapping based on a change in acceleration and transmit a signal to the processor of the hearing device. In some implementations, a tap detection algorithm is implemented in the accelerometer (e.g., in the accelerometer chip). In other implementations, a processor in the hearing device can receive information from the accelerometer, and the processor can implement a tap detection algorithm based on the received information. Also, in some implementations, the accelerometer and the processor can implement different parts of the tap detection algorithm. Based on a detected single tap or double tap, the hearing device can modify a parameter of the hearing device or perform an operation. For example, a single tap or a double tap can cause the hearing device to adjust volume, switch or modify a hearing device program, accept/reject a phone call, or implement active voice control (e.g., voice commands).

However, it is difficult to reliably detect a tap and/or a double tap. Reliably detecting a tap means reducing false positives (detected and unwanted taps or vibrations due to handling or movement of the hearing device or other body movements) and false negatives (the user tapped or double tapped but it was not detected) such that a user is satisfied with tap control performance. Further, because hearing devices have different properties that can affect tap or vibration properties the hearing device and users vary in how they tap a hearing device, a "one size fits all" configuration for tap control may be suboptimal for users.

In particular, it is difficult to detect a double tap gesture because an accelerometer needs to sense two acceleration signals with a time between the two signals of about, e.g., 200-500 milliseconds (ms). In this short amount of time, a bump of the hearing device from a pair of glasses or a shake of the head of the hearing device user can make it difficult to determine whether the detected two changes in acceleration were related to an intended double tap of the hearing device (or ear carrying the hearing device) or related to inadvertent movement or vibrations. Additionally, if a user inherently varies the way in which he or she double taps, e.g., there is often a difference in time between taps or a difference in acceleration between taps. This short time frames, variation in taps, and unintended vibrations or changes in acceleration can make it difficult to detect a double tap with certainty.

To provide improved tap control, the disclosed technology includes a hearing device that includes an accelerometer and a second sensor configured to provide a second signal that can be used to verify that a tapping gesture was robustly received. The second signal can be referred to as a verification signal.

The second sensor can be a photodiode circuit that is configured to detect a change in distance between the ear and the skull of a person wearing the hearing device. For example, the second sensor can measure a distance (d) from the hearing device to a proximal side of an ear. When the user taps the ear, the distance (d) decreases because the ear moves closer to a person's skull. See, e.g., FIG. 2A. The photodiode circuit can measure this change in distance. Based on this change in distance, the hearing device can determine that it received a tap and also detected a movement of the ear from a first position to a second position. The combination of the detection in the change in acceleration with the detected change in distance can be used by the processor the hearing device to robustly confirm a tapping gesture was received.

Other types of sensors can be used to verify that a tap gesture was received. The second sensor can also be a pressure sensor, an optical sensor, a temperature sensor, capacitive sensor (e.g., for touch detection), mechanical sensor (e.g., for touch detection), or a magnetic sensor (e.g., proximity detection). In such implementations, a processor for the hearing device would receive a signal from the accelerometer (e.g., the first sensor) and a signal from the second sensor and use the combined signals to determine that a tap gesture was correctly received.

The second sensor can also be a microphone, where when a microphone is tapped or an ear taps the microphone, the microphone generates a sound signal, and the sound signal can be used as a verification signal.

Also, in some implementations, an antenna and its transceiver can be used to measure a change in impedance, and this change in impedance can be considered a verification signal. In such implementations, the antenna can be considered a second sensor.

The hearing device can perform operations that determine a context for a hearing device and use the context to adjust tap detection parameters. In some implementations, the operations can comprise: determining a context for the hearing device based on sound received at the hearing device or a wireless communication signal from an external device received at the hearing device; adjusting a tapping sensitivity threshold of the hearing device based on the context; detecting a tap of the hearing device based on the adjusted sensitivity threshold; and modifying a parameter of the hearing device or transmitting instructions to the external device based on detecting the tap.

Here, context generally means the circumstances that form the setting for an event (e.g., before, during, or after a tap). Some examples of contexts are listening to music (e.g., while running or walking), speech, speech in noise, receiving a phone call, or listening to or streaming television. In each of these contexts, a user may tap a device differently. For example, the stop music, the hearing device user may tap a hearing device twice. To respond to a phone call, the user may tap a hearing device twice to answer the call or tap the hearing device once to reject the call.

The disclosed technology can have a technical benefit or address a technical problem for hearing device tap detection or tap control. For example, with the second sensor, the hearing device can more accurately verify that a tap gesture, such as a double tap gesture, was received. Additionally, the disclosed technology reduces false detection of taps because it can used a verification signal from the second sensor to verify that a tap from user was robustly detected.

FIG. 1 illustrates a communication environment 100. The communication environment 100 includes wireless communication devices 102 (singular "wireless communication device 102" and multiple "wireless communication devices 102") and hearing devices 103 (singular "hearing device 103" or multiple "hearing devices 103").

A hearing device user can tap the hearing devices 103 a single or multiple time. A tap can be soft, hard, quick, slow, or repeated. In some implementations, the user can use an object to assist with tapping such as a pen, pencil, or other object configured to be used for tapping the hearing device 103. Although FIG. 1 only shows a user tapping one hearing device 103, a user can tap both hearing devices simultaneously or separately. A hearing device user can also tap an ear, where the hearing device is in use for that ear (e.g., the hearing device user is wearing the hearing device on his or her ear). Also, a hearing device user can speak and generate sound waves 101 that can be captured and processed by the hearing device 103.

As shown by double-headed bold arrows in FIG. 1, the wireless communication devices 102 and the hearing devices 103 can communicate wirelessly. Wireless communication includes wirelessly transmitting information, wirelessly receiving information, or both. Each wireless communication device 102 can communicate with each hearing device 103 and each hearing device 103 can communicate with the other hearing device. Wireless communication can include using a protocol such as Bluetooth BR/EDR™, Bluetooth Low Energy™, a proprietary protocol communication (e.g., binaural communication protocol between hearing aids based on NFMI or bimodal communication protocol between hearing devices), ZigBee™, Wi-Fi™, or an Industry of Electrical and Electronic Engineers (IEEE) wireless communication standard.

The wireless communication devices 102 shown in FIG. 1 can include mobile computing devices (e.g., mobile phone or tablet), computers (e.g., desktop or laptop), televisions (TVs) or components in communication with television (e.g., TV streamer), a car audio system or circuitry within the car, tablet, remote control, an accessory electronic device, a wireless speaker, or watch.

A hearing device user can wear the hearing devices 103 and the hearing devices 103 provide audio to the hearing device user. A hearing device user can wear single hearing device 103 or two hearing devices, where one hearing device 103 is on each ear. Some example hearing devices include hearing aids, headphones, earphones, assistive listening devices, or any combination thereof; and hearing devices include both prescription devices and non-prescription devices configured to be worn on or near a human head.

As an example of a hearing device, a hearing aid is a device that provides amplification, attenuation, or frequency modification of audio signals to compensate for hearing loss or difficulty; some example hearing aids include a Behind-the-Ear (BTE), Receiver-in-the-Canal (RIC), In-the-Ear (ITE), Completely-in-the-Canal (CIC), Invisible-in-the-Canal (IIC) hearing aids or a cochlear implant (where a cochlear implant includes a device part and an implant part).

The hearing devices 103 are configured to binaurally or bimodally communicate. The binaural communication can include a hearing device 103 transmitting information to or receiving information from another hearing device 103. Information can include volume control, signal processing information (e.g., noise reduction, wind canceling, directionality such as beam forming information), or compression information to modify sound fidelity or resolution. Binaural communication can be bidirectional (e.g., between hearing devices) or unidirectional (e.g., one hearing device receiving or streaming information from another hearing device). Bimodal communication is like binaural communication, but bimodal communication includes two devices of a different type, e.g. a cochlear device communicating with a hearing aid. The hearing device can communicate to exchange information related to utterances or speech recognition.

The network 105 is a communication network. The network 105 enables the hearing devices 103 or the wireless communication devices 102 to communicate with a network or other devices. The network 105 can be a Wi-Fi™ network, a wired network, or e.g. a network implementing any of the Institute of Electrical and Electronic Engineers (IEEE) 802.11 standards. The network 105 can be a single network, multiple networks, or multiple heterogeneous networks, such as one or more border networks, voice networks, broadband networks, service provider networks, Internet Service Provider (ISP) networks, and/or Public Switched Telephone Networks (PSTNs), interconnected via gateways operable to facilitate communications between and among the various networks. In some implementations, the network 105 can include communication networks such as a Global System for Mobile (GSM) mobile communications network, a code/time division multiple access (CDMA/TDMA) mobile communications network, a 3rd, 4th or 5th generation (3G/4G/5G) mobile communications network (e.g., General Packet Radio Service (GPRS)) or other communications network such as a Wireless Local Area Network (WLAN).

Figure 2A:
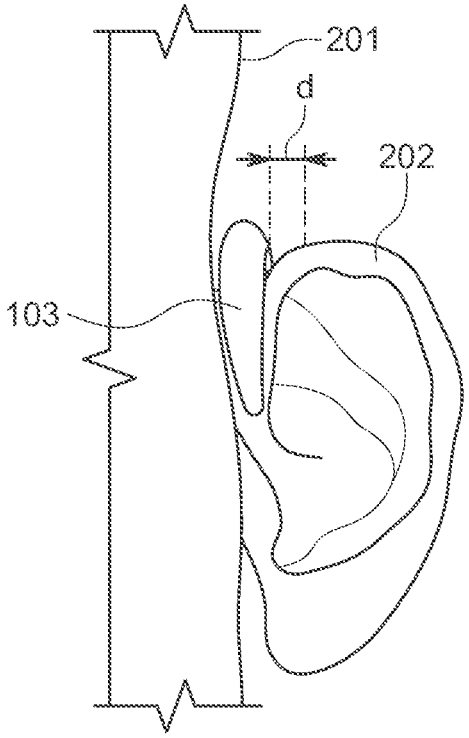
FIG. 2A illustrates a hearing device from FIG. 1 at the ear level in accordance with some implementations of the disclosed technology.

FIG. 2A illustrates a hearing device from FIG. 1 in more detail at the ear level. FIG. 2A shows a hearing device 103 positioned on a person's ear next to their skull 201. The hearing device 103 can have a housing that rests on a part of the ear 202. The hearing device can have various shapes such that it fits between the ear 202 and the skull 201.

As shown in FIG. 2A, there is a distance (d) between the skull 201 and the ear 202. This distance can vary depending on a hearing device user's anatomy. And as explained in more detail in FIGS. 2B, 3, and 4, the hearing device 103 can include a second sensor that is configured to measure the distance (d) or changes in the distance (d). For example, the second sensor can include a photodiode that is configured to measure the changing distance (d) when a user taps the ear 202 (e.g., the ear moves closer to the skull or may even move farther away depending on the tap). The second sensor can transmit the change in distance (d) to the processor of the hearing device, wherein the signal can be considered a verification signal because it can be used with other parameters (e.g., signals from an accelerometer) to determine that an intended tap occurred. Also, as further explained below, the second sensor can measure distance (d) to determine that a double tap has occurred, e.g., the distance (d) changed twice in a period time in response to a user tapping the ear 202 twice.

Although not shown in FIG. 2A, the sensor can be placed at different locations on the hearing device to optimize performance, especially, e.g., based on the type of sensor. For example, if the sensor is a photodiode the sensor can be placed in a location on the side of the hearing device that is closest to the ear. If the sensor is a temperature sensor, the temperature sensor can be place in a location such that when an ear is tapped, it touches the temperature sensor and the change in temperature is sensed. Similarly, if the sensor is a pressure sensor or capacitive sensor, it can be placed in location on the hearing device such that if an ear is tapped, the ear touches the sensor. Alternatively, the sensor can be placed in a location where it is easy for a hearing device user to tap hearing device and the sensor at the same time (e.g., at the bottom of the hearing device or top of the hearing device).

In some implementations, the microphone 350 can be considered the sensor. For example, when a microphone is tapped or touch (e.g., by an ear or directly with a finger), it can generate a sound that is distinct to tapping. The sound associated with the tapping can be used as the verification signal.

In some implementations, the hearing device 103 can be positioned to be partially or completely within an ear canal, and in such implementations the second sensor can provide a different type of verification signal, e.g., temperature, capacitance, pressure, electrical impedance, or another signal. The sensors can also be placed in different locations based on whether the hearing device is configured to a left ear or a right ear.

Figure 2B:
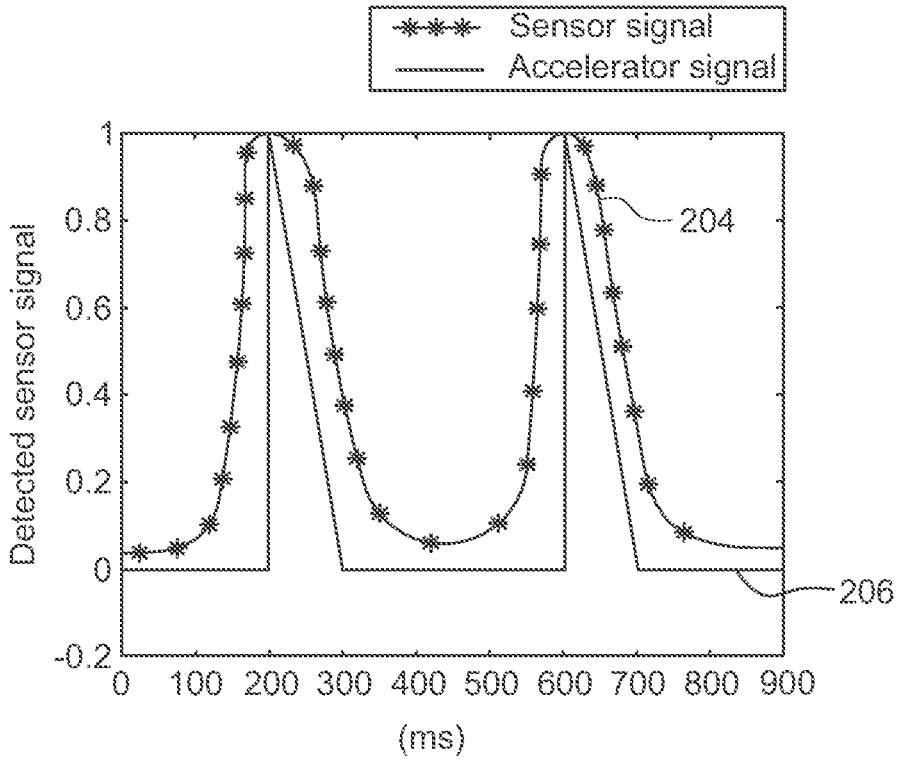
FIG. 2B is a graph illustrating detected acceleration in response to tapping a hearing device in accordance with some implementations of the disclosed technology.

FIG. 2B is a graph illustrating detected acceleration in response to tapping a hearing device. On the y-axis is confidence that a signal was measured (in normalized units from 0-100) and on the x-axis is time (e.g., in milliseconds (ms)). The signal associated with the confidence of a change in acceleration (e.g., the tapping signal received from the accelerometer) is shown as a single line 206. The signal associated with the second sensor (e.g., a photodiode sensor) is shown as a line 204 with stars.

The graph shows two taps, a first tap followed by a second tap with respective peaks. The two taps are associated with a change in acceleration of the hearing device worn on a user's ear (e.g., a double tap). The graph also shows that the second sensor is producing a verification signal that can be used to verify the double tap was intended double tap gesture and not a mistake or false positive. For example, the sensor signal 204 can be used to measure the change in distance between the ear 202 (FIG. 2A) and the skull 201 to determine that a user's ear is also moving in response to the double tap of an ear. The combination of the verification from the photodiode sensor with the tapping signal measuring changes in acceleration provides the processor the hearing device with a robust calculation for determining that a tapping gesture was intended and robustly detected. The peaks, parameters, or value of these signals can be measured and/or compared to threshold values to define values or ranges where the confidence of a receiving a tap gesture robustly is high (e.g., greater than 90%).

FIG. 2B can be used to determine a correlation between the tapping signal and the verification signal. For example, when the timing of a tapping signal is correlated with a verification signal within a predetermined range, this correlation can be used to robustly determine that a tapping gesture was received. The location of thresholds (e.g., the peak of a tap or the trough of a tap) correlated with a verification signal can be used to determine that a tapping gesture was received. Also, the timing of the tapping signal compared to the timing of the verification signal can be used to determine that a tapping gesture was robustly detected.

In some implementations, the tapping signal or the verification signal can serve as a gate. For example, if the accelerometer detects a change in acceleration a gate is opened and a tap gesture is confirmed if the verification is received while the gate is opened (or vice versa). The gate can function as an "and" gate, where both the verification signal and the tapping signal must be received for the tapping gesture to be received.

Figure 3:
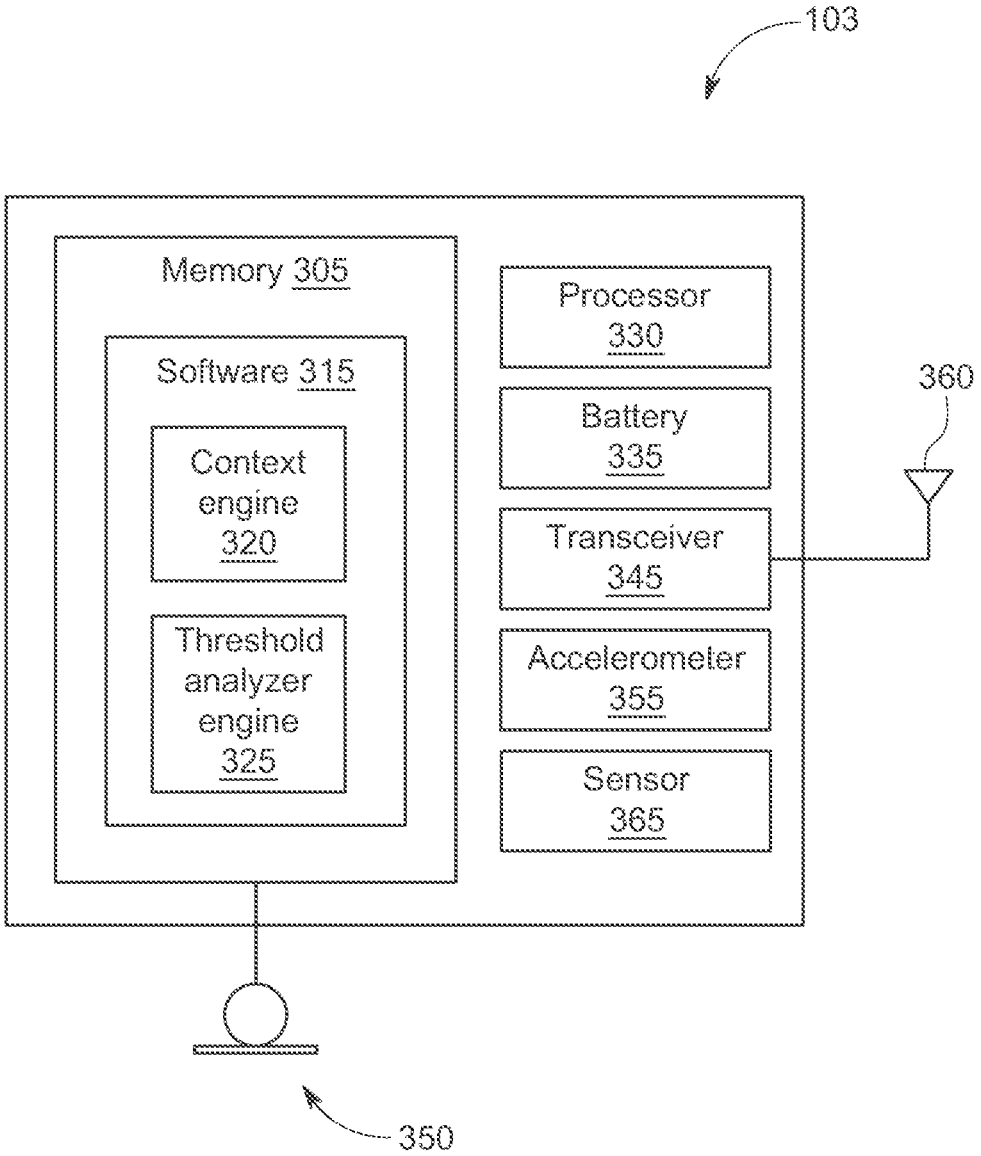
FIG. 3 illustrates a hearing device from FIG. 1 in more detail in accordance with some implementations of the disclosed technology.

FIG. 3 is a block diagram illustrating the hearing device 103 from FIG. 1 in more detail. FIG. 3 illustrates the hearing device 103 with a memory 305, software 315 stored in the memory 305, the software 315 includes a context engine 320 and a threshold analyzer 325. The hearing device 103 in FIG. 3 also has a processor 330, a battery 335, a transceiver 345 coupled to an antenna 360, an accelerometer 355 (also referred to as a "first sensor"), a sensor 365 (also referred to as "a second sensor"), and a microphone 350. Each of these components is described below in more detail.

The memory 205 stores instructions for executing the software 315 comprised of one or more modules, data utilized by the modules, or algorithms. The modules or algorithms perform certain methods or functions for the hearing device 103 and can include components, subcomponents, or other logical entities that assist with or enable the performance of these methods or functions. Although a single memory 305 is shown in FIG. 3, the hearing device 103 can have multiple memories 305 that are partitioned or separated, where each memory can store different information.

The context engine 320 can determine a context for a single hearing device 103 or both hearing devices 103. A context can be based on the sound received at the hearing device. For example, the context engine 320 can determine that a user is in a quiet environment because there is little sound or soft sound received at the hearing device 103. Alternatively, the context engine 320 can determine the context of a hearing device is in a loud environment such as at a restaurant with music and many people carrying on conversations.

The context engine 320 can also determine context based on sound classification (e.g., performed in a DSP). Sound classification is the automatic recognition of an acoustic environment for the hearing device. The classification can be speech, speech in noise, noise, or music. Sound classification can be based on amplitude modulations, spectral profile, harmonicity, amplitude onsets, and rhythm. The context engine 320 can perform classification algorithms based on rule-based and minimum-distance classifiers, Bayes classifier, neural network, and hidden Markov model.

In some implementations, the classification may result in two or more recommended setting for the hearing device (e.g., speech-in-noise setting versus comfort). And the classifier may determine that the two recommended settings have nearly equal recommendation probability (e.g., 50/50 or 60/40). If the classifier for the hearing device selects one setting and the hearing device user does not like it, he or she may tap once or twice to change the setting to the secondary recommendation setting. In these implementations, a user appreciates the verification of a tap gesture.

The context engine 320 can also determine context based on communication with an external device. For example, the context engine 320 can determine that the hearing device 103 received a request from a mobile phone, and the mobile phone is asking the user if he or she wants to answer or reject the phone call. The context engine 320 can thus determine that the context is answering a phone call. More generally, if a wireless communication device 102 sends a request to the hearing device, the hearing device can use this request to determine the context. Some examples of requests include a request to use a wireless microphone, a request to provide audio or information to the hearing device (based on the user's permission), or a request to connect to the wireless device 102 (e.g., TV controller). In response to his request and the context, the hearing device 103 can anticipate a tap or multiple taps from the user (e.g., an associated tap gesture).

The threshold analyzer 325 can analyze signals received from the accelerometer 355 or the sensor 365. Generally, a tap is detected if a certain acceleration value or slope of acceleration in a single or multiple dimensions is measured. If the threshold of detection is too low, then chances of false positives are high. If the threshold is too high, then the probability of not detecting a tap is high. Also, a tap is not just detected by magnitude, but also by the slope of acceleration (e.g., change in acceleration) or the duration of acceleration. Additionally, if a hearing device uses double or multiple tapping control, the threshold analyzer 325 can adjust the time expected between taps. The threshold analyzer 325 can use preset values or predetermined ranges of values associated with an authentic tap or double tap when determining whether received signal from an accelerometer can be used to robustly detect a tap gesture. The preset values or predetermined ranges can be based on machine learning, training of the accelerometer, factory settings of the hearing device, or averages based on testing several hearing device users implementing tap gestures.

The threshold analyzer 325 can also use a signal from the sensor 365. Depending on type of sensor, the threshold analyzer 325 can have threshold values for the verification signal received from sensor 365. For example, it can detect a preset distance (d) between an ear and the hearing device that relates to a normal distance and then a compared detected values to that distance to determine if a change occurred. The sensor 365 can also determine that a preset a certain amount of distance was achieved (e.g., more than 2 mm), which indicates a tap occurred. With other sensors, the threshold analyzer 325 can use relevant values related to capacity, temperature, electrical impedance, or magnetic fields to determine there was a change detected. The processor 330 can use this information to verify that a tap gesture was detected in combination with the acceleration 355 signals.

The processor 330 can include special-purpose hardware such as application specific integrated circuits (ASICs), programmable logic devices (PLDs), field-programmable gate arrays (FPGAs), programmable circuitry (e.g., one or more microprocessors microcontrollers), Digital Signal Processor (DSP), Neural network engines, appropriately programmed with software and/or computer code, or a combination of special purpose hardware and programmable circuitry. Especially, neural network engines might be analog or digital in nature and contain single or multiple layers of feedforward or feedback neuron structures with short and long-term memory and/or different nonlinear functions.

Also, although the processor 330 is shown as a separate unit in FIG. 3, the processor 330 can be on a single chip with the transceiver 345, and the memory 305. The processor 330 can also include a DSP configured to modify audio signals based on hearing loss or hearing programs stored in the memory 305. In some implementations, the hearing device 103 can have multiple processors, where the multiple processors can be physically coupled to the hearing device 103 and configured to communicate with each other.

The battery 335 can be a rechargeable battery (e.g., lithium ion battery) or a non-rechargeable battery (e.g., Zinc-Air) and the battery 335 can provide electrical power to the hearing device 103 or its components. In general, the battery 335 has significantly less available capacity than a battery in a larger computing device (e.g., a factor 100 less than a mobile phone device and a factor 1000 less than a laptop).

The accelerometer 355 can be positioned inside or on the outside of the hearing device and detect acceleration changes of the hearing device. The accelerometer 355 can be a capacitive accelerometer, a piezoelectric accelerometer, or another type of accelerometer. In some implementations, the accelerometer can measure acceleration along only a single axis. In other implementations, the accelerometer can sense acceleration along two axes or three axes. For example, the accelerometer can create a 3D vector of acceleration in the form of orthogonal components. The accelerometer can output a signal that is received by the processor 330. The acceleration can be output in meters/second$^2$ or g's (1 g=9.81 meters/second$^2$). In some implementations, the accelerometer can detect acceleration changes from +2 g's to +16 g's sampled at a frequency of greater than 100 Hz, e.g., 200 Hz.

The accelerometer 355 can also be in a housing of the hearing device, where the housing is located behind a user's ear. Alternatively, the accelerometer 355 can be located in a housing for a hearing device, wherein the housing is inside a user's ear canal or at least partially inside a user's ear. The accelerometer 355 can be an ultra-low power device, wherein the power consumption is within a range or 10 micro Amps (μA). The accelerometer 355 can be a micro-electro-mechanical system (MEMS) or nanoelectromechanical system (NEMS).

The sensor 365 is configured to provide a verification signal that can be used to verify that a tap gesture in combination with a signal from the accelerometer 355. The sensor 365, also referred to as the second sensor (e.g., because the accelerometer 355 is the first sensor), can be a photodiode sensor, temperature sensor, capacitive sensor, a mechanical sensor configured to detect touch, or a magnetic sensor configured to detect proximity of an ear to the hearing device. The temperature sensor can measure a change in temperature associated with the vibration or an ear or part of an ear. The capacitive sensor can change in capacity related to a user touching a hearing device or an ear touching a hearing device. The magnetic sensor can measure a change in the magnetic field associated with moving ear or a touch of a hearing device.

In implementations where the sensor 365 is a photodiode sensor, the sensor comprises a photodiode configured to measure a change in a distance between the second sensor and an ear, wherein the hearing device is at least partially in contact with the ear. See, e.g., FIG. 2A.

In some implementations, the sensor can be a pressure sensor, an optical sensor, or a medical sensor. For the pressure sensor, the verification signal can be related to the a change in pressure associated with an ear area being pushed, e.g., an ear being pressed against a sensor on the hearing device in response to the ear being tapped.

Also, in some implementations, an antenna and its transceiver can be used to measure a change in impedance, and this change in impedance can be considered a verification signal. In such implementations, the antenna can be considered a second sensor. For example, when a hearing device is moved because a person tapped the hearing device or an ear moves closer to the hearing device, the antenna can experience a change in impedance that can be measured. This change in impedance can be transmitted by the transceiver to the processor, and the processor can use it as a verification signal from the second sensor. In some implementations, the impedance can be compared between a left hearing device and a right hearing device. If the right hearing device or left hearing device experiences a different impedance, it can be determined that a the right or left hearing device was tapped.

Regardless of which sensor is used, the output from that sensor can be used in combination from with the output from the accelerometer to measure change in acceleration. The combination of these two signals used by the processor 330 provides a more robust detection of a tapping gesture as compared to a single sensor.

The microphone 350 is configured to capture sound and provide an audio signal of the captured sound to the processor 330. The microphone 350 can also convert sound into audio signals. The processor 330 can modify the sound (e.g., in a DSP) and provide the processed audio derived from the modified sound to a user of the hearing device 103. Although a single microphone 350 is shown in FIG. 3, the hearing device 103 can have more than one microphone. For example, the hearing device 103 can have an inner microphone, which is positioned near or in an ear canal, and an outer microphone, which is positioned on the outside of an ear. As another example, the hearing device 103 can have two microphones, and the hearing device 103 can use both microphones to perform beam forming operations. In such an example, the processor 330 would include a DSP configured to perform beam forming operations.

The antenna 360 can be configured for operation in unlicensed bands such as Industrial, Scientific, and Medical Band (ISM) using a frequency of 2.4 GHz. The antenna 360 can also be configured to operation in other frequency bands such as 5.8 GHz, 3.8 MHz, 10.6 MHz, or other unlicensed bands.

Although not shown in FIG. 3, the hearing device 103 can include additional components. For example, the hearing device can also include a transducer to output audio signals (e.g., a loudspeaker or a transducer for a cochlear device configured to convert audio signals into nerve stimulation or electrical signals). Further, although not shown in FIG. 3, the hearing device can include sensors such as a photoplethysmogram (PPG) sensor or other sensors configured to detect health conditions regarding the user wearing the hearing device 103.

Also, the hearing device 103 can include an own voice detection unit configured to detect a voice of the hearing device user and separate such voice signals from other audio signals. To implement detecting own voice, the hearing device can include a second microphone configured to convert sound into audio signals, wherein the second microphone is configured to receive sound from an interior of an ear canal and positioned within the ear canal, wherein a first microphone is configured to receive sound from an exterior of the ear canal. The hearing device can also detect own voice of a hearing device user based on other implementations (e.g., a digital signal processing algorithm that detects a user's own voice).

Figure 4:
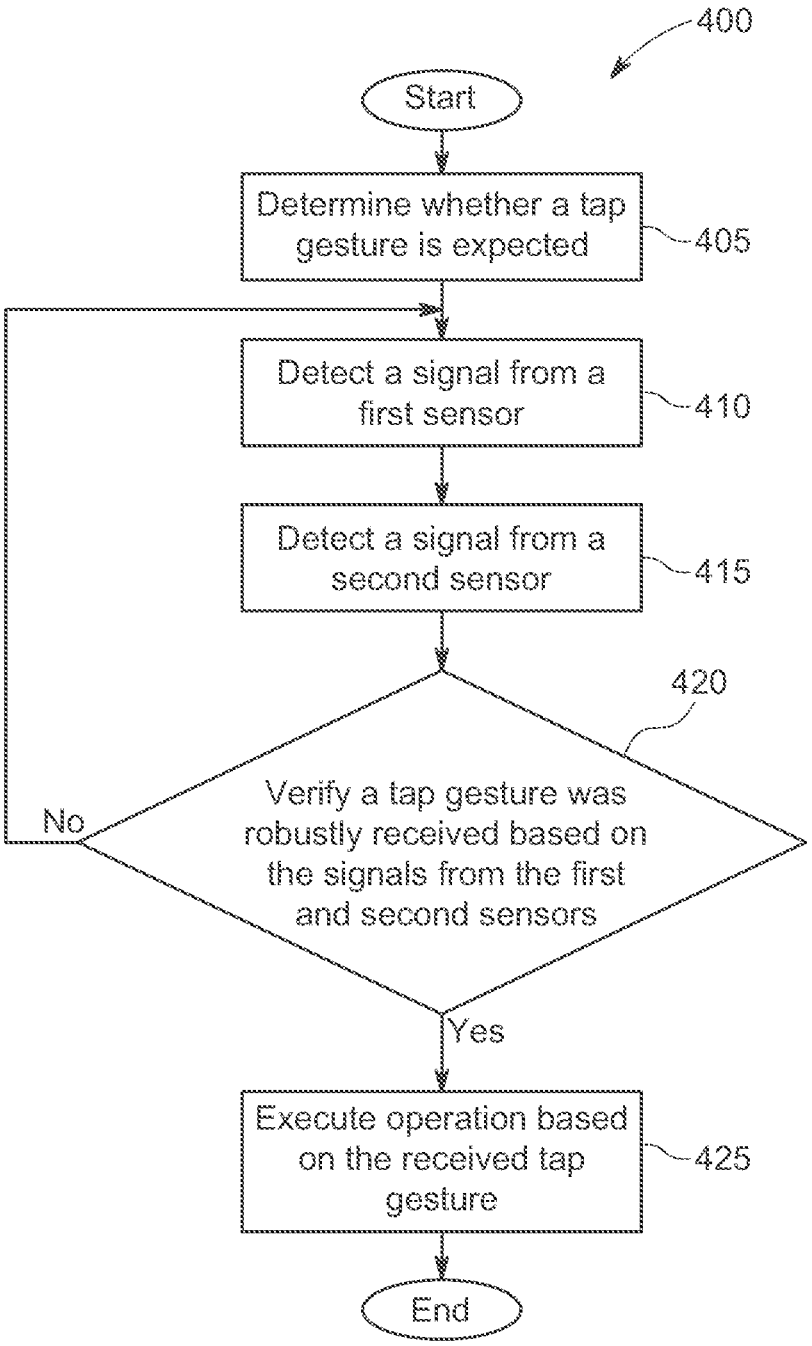
FIG. 4 is a block flow diagram illustrating a process to detect a tapping gesture in accordance with some implementations of the disclosed technology.

FIG. 4 illustrates a block flow diagram for a process 400 for detecting a tap gesture for a hearing device with an accelerator and a second sensor. The hearing device 103 can perform part or all of the process 400. The process 400 can optionally begin with detecting that a user is wearing a hearing device and continue to determine context operation 405. The process 400 is considered an algorithm to detect a tap gesture for a hearing device.

At determine context operation 405, the hearing device determines whether a tap gesture is expected based on the context of the hearing device. The hearing device can determine the context for a hearing device in several ways. In some implementations, the hearing device determines based on the context of the classification of the hearing device (e.g., using a DSP or the classifier of a hearing device). The classification can be speech, speech in noise, quiet, or listening to music. In each of these classified settings, the hearing device can have different tap gestures associated with the classification setting. For example, a double tap gesture can be associated with changing a song or answering a phone call. In a noisy environment classification, a double tap can be associated with adjusting the beamformer of a hearing device.

Additionally or alternatively, the hearing device can determine its context based on a communication with an external device (e.g., a mobile device asking if the user wants to answer or decline a call). For example, the hearing device can determine a context for the hearing device based on the wireless communication signal from an external device received at the hearing device, and wherein the wireless communication signal is from a mobile device and the wireless communication signal is related to answering or rejecting a phone call. The tap gesture associated with answering a call can be a double tap gesture and the tap gesture associated with rejecting a call can be single tap (or vice versa).

At receive first signal operation 410, the hearing device receives a tapping signal from a first sensor. The first sensor can be an accelerometer (e.g., FIG. 3) that is configured to detect a change in acceleration associated with the hearing device (e.g., a single tap or double tap). The tapping signal can include multiple acceleration changes associated with tapping or movement of the hearing device. In some implementations, the processor of the hearing device can filter the tapping signal to look for taps that meet a certain threshold as described in U.S. patent application Ser. No. 16/368,880 filed on Mar. 29, 2019, titled "Adaptive Tapping for Hearing Devices."

At receive second signal operation 415, the hearing device receives a verification signal from a second sensor. The second sensor can be a photodiode sensor, temperature sensor, a capacitive sensor, a mechanical sensor configured to detect touch, or a magnetic sensor configured to detect proximity of an ear to the hearing device. When the second sensor is a photodiode sensor, the verification signal can include a signal that relates to a change in distance (d) between the hearing device and the ear. See, e.g., FIG. 2A. The processor of the hearing device can use the second signal from the second sensor (also referred to as the "verification signal") to verify that a tap gesture was received.

At verification operation 420, the hearing device verifies or determines that a tap gesture was robustly received based receiving the first and second signal from the first and second sensors, respectively. The second signal is considered a verification signal because it can be used to verify that the first signal was not an unintended signal, but rather it was intended because the second sensor also noticed a change in addition to the first sensor. For example, the first sensor can be an accelerometer and the processor can use a signal from it to detect an acceleration corresponding to a double tap, and additionally, a photodiode sensor can sense that an ear moved closer to a person's skull twice (FIG. 2A) which is also an indication that a double tap was received. The hearing device can use thresholds to determine the tap gesture was received robustly. For example, the hearing device can determine that accelerations below a certain acceleration level do not trigger a need to use the verification signal. U.S. patent application Ser. No. 16/368,880 filed on Mar. 29, 2019, titled "Adaptive Tapping for Hearing Devices," discloses how these thresholds can be determined.

Although an accelerometer and photodiode sensor can be used in the verification step 420, the hearing device can use other sensors. For example, it can use a gyroscope, temperature sensor, capacitance sensor, or magnetic sensor as the first or second sensor.

At modify hearing device or perform operation 425, the hearing device modifies the hearing device or performs or executes an operation. The hearing device can modify the hearing device to change a parameter based on the detected tap or taps. The hearing device can change the hearing profile, the volume, the mode of the hearing device, or another parameter of the hearing device in response to receiving the tap gesture. For example, the hearing device can increase or decrease the volume of a hearing device based on the detected tap. Additionally, the hearing device can perform an operation in response to a tap. For example, if the hearing device receive a request to answer a phone and it detected a single tap (indicating the phone call should be answered), the hearing device can transmit a message to a mobile phone communicating with the hearing device to answer the phone call. Alternatively, the hearing device can transmit a message to the mobile phone to reject the phone call based on receiving a double tap.

The hearing device can perform other operations based on receiving a single or double tap. The hearing device can accept a wireless connection, confirm a request from another wireless device, cause the hearing device to transmit a message (e.g., a triple tap can indicate to other devices that the hearing device is unavailable for connecting).

After modify hearing device or perform operation 425, the process 400 can be repeated entirely, repeated partially (e.g., repeat only operation 410), or stop.

Aspects and implementations of the process 400 of the disclosure have been disclosed in the general context of various steps and operations. A variety of these steps and operations may be performed by hardware components or may be embodied in computer-executable instructions, which may be used to cause a general-purpose or special-purpose processor (e.g., in a computer, server, or other computing device) programmed with the instructions to perform the steps or operations. For example, the steps or operations may be performed by a combination of hardware, software, and/or firmware such with a wireless communication device or a hearing device.

The phrases "in some implementations," "according to some implementations," "in the implementations shown," "in other implementations," and generally mean a feature, structure, or characteristic following the phrase is included in at least one implementation of the disclosure, and may be included in more than one implementation. In addition, such phrases do not necessarily refer to the same implementations or different implementations.

The techniques introduced here can be embodied as special-purpose hardware (e.g., circuitry), as programmable circuitry appropriately programmed with software or firmware, or as a combination of special-purpose and programmable circuitry. Hence, implementations may include a machine-readable medium having stored thereon instructions which may be used to program a computer (or other electronic devices) to perform a process. The machine-readable medium may include, but is not limited to, read-only memory (ROM), random access memories (RAMs), erasable programmable read-only memories (EPROMs), electrically erasable programmable read-only memories (EEPROMs), magnetic or optical cards, flash memory, or other type of media/machine-readable medium suitable for storing electronic instructions. In some implementations, the machine-readable medium is non-transitory computer readable medium, where in non-transitory excludes a propagating signal.

The above detailed description of examples of the disclosure is not intended to be exhaustive or to limit the disclosure to the precise form disclosed above. While specific examples for the disclosure are described above for illustrative purposes, various equivalent modifications are possible within the scope of the disclosure, as those skilled in the relevant art will recognize. For example, while processes or blocks are presented in an order, alternative implementations may perform routines having steps, or employ systems having blocks, in a different order, and some processes or blocks may be deleted, moved, added, subdivided, combined, or modified to provide alternative or subcombinations. Each of these processes or blocks may be implemented in a variety of different ways. Also, while processes or blocks are at times shown as being performed in series, these processes or blocks may instead be performed or implemented in parallel, or may be performed at different times. Further any specific numbers noted herein are only examples: alternative implementations may employ differing values or ranges.

As used herein, the word "or" refers to any possible permutation of a set of items. For example, the phrase "A, B, or C" refers to at least one of A, B, C, or any combination thereof, such as any of: A; B; C; A and B; A and C; B and C; A, B, and C; or multiple of any item such as A and A; B, B, and C; A, A, B, C, and C; etc. As another example, "A or B" can be only A, only B, or A and B.

The invention claimed is:

1. A hearing device comprising:

a processor configured to control operation of the hearing device; and a memory, electronically coupled to the processor, storing instructions that when executed by the processor cause the hearing device to perform operations, the operations comprising:

determine a context for the hearing device based on a classification of ambient sound received at the hearing device, the classification corresponding to one or more of speech, speech in noise, noise, or music;

determine, based on the classification of the ambient sound, a first recommended setting for the hearing device and a second recommended setting for the hearing device;

select the first recommended setting for use by the hearing device;

activate, in response to the determining of the context, a tap gesture feature to cause the hearing device to begin waiting for a tapping signal;

receive the tapping signal from a first sensor configured to detect a change in acceleration of the hearing device;

receive a verification signal from a second sensor;

based on the received tapping signal and the received verification signal, determine that the tapping signal relates to a tap gesture associated with the hearing device; and use, based on the tap gesture, the second recommended setting instead of the first recommended setting.

2. The hearing device of claim 1, wherein the second sensor comprises a photodiode configured to measure a change in a distance between the second sensor and an ear, wherein the hearing device is at least partially in contact with the ear.

3. The hearing device of claim 2, wherein the measured distance between the second sensor and the ear is a parameter used to determine that the tapping signal relates to the tap gesture.

4. The hearing device of claim 1, wherein the first sensor is an accelerometer and wherein the second sensor comprises a photodiode.

5. The hearing device of claim 1, wherein the tap gesture is associated with single or double tapping.

6. The hearing device of claim 1, wherein the context is further based on a wireless communication signal from an external device received at the hearing device, and wherein the wireless communication signal is from a mobile device and the wireless communication signal is related to answering or rejecting a phone call.

7. The hearing device of claim 1, wherein determining that the tapping signal relates to the tap gesture further comprises:

determine that a threshold of the verification signal has been met.

8. The hearing device of claim 1, wherein the second sensor comprises a temperature sensor, a capacitive sensor, a microphone configured to generate a sound when tapped, a mechanical sensor configured to detect touch, an antenna, a pressure sensor, or a magnetic sensor configured to detect proximity of an ear to the hearing device.

9. The hearing device of claim 1, wherein one or more classification algorithms are used to determine the context, the classification algorithms including at least one of rule-based and minimum-distance classifiers, a Bayes classifier, a neural network, or a hidden Markov model.

10. The hearing device of claim 1, wherein the processor is further configured to execute the instructions to cause the hearing device to adjust a tapping sensitivity threshold of the hearing device based on the context.

11. The hearing device of claim 1, wherein the classification is based on amplitude modulations, spectral profile, harmonicity, amplitude onsets, and rhythm.

12. The hearing device of claim 1, wherein the first recommended setting and the second recommended setting each have a substantially equal recommendation probability.

13. A method to detect a tap gesture, the method comprising:

determining a context for a hearing device based on a classification of ambient sound received at the hearing device, the classification corresponding to one or more of speech, speech in noise, noise, or music;

determining, based on the classification of the ambient sound, a first recommended setting for the hearing device and a second recommended setting for the hearing device;

selecting the first recommended setting for use by the hearing device;

activate, in response to the determining of the context, a tap gesture feature to cause the hearing device to begin waiting for a tapping signal;

receiving the tapping signal from a first sensor configured to detect a change in acceleration of the hearing device;

receiving a verification signal from a second sensor;

based on the received tapping signal and the received verification signal, determining that the tapping signal relates to a tap gesture associated with the hearing device; and directing, based on the tap gesture, the hearing device to use the second recommended setting instead of the first recommended setting.

14. The method of claim 13, the context is further based on a wireless communication signal from an external device received at the hearing device or information received from an accelerometer.

15. The method of claim 13, wherein the verification signal includes information associated with a change in a distance between an ear in physical contact with the hearing device and the second sensor.

16. A non-transitory computer-readable medium storing instructions that when executed by a processor cause a hearing device to perform operations, the operations comprising:

determine a context for the hearing device based on a classification of ambient sound received at the hearing device, the classification corresponding to one or more of speech, speech in noise, noise, or music;

determine, based on the classification of the ambient sound, a first recommended setting for the hearing device and a second recommended setting for the hearing device;

select the first recommended setting for use by the hearing device;

activate, in response to the determining of the context, a tap gesture feature to cause the hearing device to begin waiting for a tapping signal;

receive the tapping signal from a first sensor configured to detect a change in acceleration of the hearing device;

receive a verification signal from a second sensor;

based on the received tapping signal and the received verification signal, determine that the tapping signal relates to a tap gesture associated with the hearing device; and use, based on the tap gesture, the second recommended setting instead of the first recommended setting.

17. The non-transitory computer readable medium of claim 16, wherein the operations further comprise:

adjust a tapping period based on determining that a quiet period or shock period time has expired before detecting the second tap.

18. The non-transitory computer readable medium of claim 16, wherein the context for the hearing device is further based on a wireless communication signal from an external device received at the hearing device or information received from an accelerometer.

19. The non-transitory computer readable medium of claim 16, wherein the verification signal is associated with a change of impedance of an antenna of the hearing device.

* * * * *